US008302542B2

(12) United States Patent
Ma

(10) Patent No.: US 8,302,542 B2
(45) Date of Patent: Nov. 6, 2012

(54) FURNITURE FRAME ASSEMBLED TOGETHER WITHOUT USING TOOLS

(76) Inventor: Joen-Shen Ma, Taipei (TW)

( * ) Notice: Subject to any disclaimer, the term of this patent is extended or adjusted under 35 U.S.C. 154(b) by 336 days.

(21) Appl. No.: 12/789,619

(22) Filed: May 28, 2010

(65) Prior Publication Data

US 2011/0291457 A1 Dec. 1, 2011

(51) Int. Cl.
*A47B 13/02* (2006.01)
*A47B 13/12* (2006.01)
*A47B 47/03* (2006.01)

(52) U.S. Cl. ..... 108/180; 108/184

(58) Field of Classification Search ..... 108/193, 108/115, 184, 180, 187; 312/7.2, 257.1, 312/263, 265.1, 265.4, 351
See application file for complete search history.

(56) References Cited

U.S. PATENT DOCUMENTS 2,806,755 A * 9/1957 Glass ..... 312/265.4
4,187,649 A * 2/1980 Chaffee ..... 312/265.1
5,584,545 A * 12/1996 LaVaute et al. ..... 108/115
7,337,732 B2 * 3/2008 Becker et al. ..... 108/193
8,015,930 B2 * 9/2011 Huang ..... 108/193
2003/0151338 A1 * 8/2003 Chen ..... 312/257.1

* cited by examiner

*Primary Examiner* — Michael Safavi
(74) *Attorney, Agent, or Firm* — Rosenberg, Klein & Lee

(57) ABSTRACT

A furniture frame includes an assembly of a front frame, a pair of side racks, and a rear board. The front frame includes a closed frame structure made of a tubular member and forms four fitting lugs at a rear side portion thereof in a symmetric manner. The two side racks are made of tubular members to each assume a lying U-shaped structure and each lying-U-shape has an open side at which free ends of limbs of the U-shape each form a bent section. The two side racks are of a symmetric arrangement and structure so that the bent sections are respectively fit into the fitting lugs to demonstrate an expanding resiliency between the connection sections of the two side racks. The rear board is a flat plate having opposite edges that are bent in an arc form to construct pawls thereon, and the pawls on the opposite edges of the rear board are sized and positioned to respectively receive and thus engage the connection sections of the side racks. With such a structural arrangement, the front frame, the side racks, and the rear board can be efficiently assembled together without use of tool to thereby provide a stable and firm furniture frame.

9 Claims, 5 Drawing Sheets

FURNITURE FRAME ASSEMBLED TOGETHER WITHOUT USING TOOLS

BACKGROUND OF THE INVENTION

1. Field of the Invention

The present invention relates to a furniture frame, and in particular to a furniture frame that includes an assembly of a front frame, a pair of side racks and a rear board that can be efficiently assembled together without using any tool to provide a stable and firm furniture frame.

2. The Related Arts

Furniture of various function and models is available in the markets. Conventionally, the furniture is often made of wooden materials. With the current trend of green industry and environmental protection, woods are severely protected and cutting trees is subjected to severe regulations and laws. The furniture industry starts to use other composite materials to replace the wooden materials for making more fashionable and modern pieces of furniture.

One of the most pronounced challenges of using composite materials to make furniture is the combination or jointing between different materials. This makes the manufacturing of furniture complicated, leading to increase of costs and expense. This is one of the most troublesome issues that the industry has to resolve.

SUMMARY OF THE INVENTION

Thus, the present invention provides a novel design of furniture frame, which effectively reduce the assembling time of furniture, simplifies the assembling and manufacturing process, and also reduces the labor hour costs of manufacturing furniture.

An objective of the present invention is to provide a furniture frame that includes an assembly of a front frame, a pair of side racks and a rear board that can be efficiently assembled together without using any tool to provide a stable and firm furniture frame.

To realize the above objective, the present invention provides the following technique solution:

The furniture frame of the present invention generally comprises a front frame, a pair of side racks, and a rear board, which are assembled together to form the furniture frame of the present invention.

The front frame is made of a tubular member and assumes a closed frame like structure. Four fitting lugs are mounted to a rear side portion of the front frame in a substantially symmetric manner.

The two side racks are made of tubular members to each assume a lying U-shaped structure having an open side at which free ends of the limbs of the U-shape each form a bent section that is configured to fit into a corresponding one of the fitting lugs.

The rear board is in the form of a flat plate having opposite edges that are bent in an arc form to construct pawls on the edges. The pawls on the opposite edges of the rear board are sized and positioned to respectively receive and thus engage connection sections that connect between limbs of the side racks.

The side racks are arranged and constructed in a symmetric manner. In assembling, the two bent sections on the open side of the left side rack are respectively fit into the two fitting lugs on the left half of the front frame, while the two bent sections on the open side of the right side rack are respectively fit into the two fitting lugs on the right half of the front frame.

Each bent section is of a bending angle that is deliberately set so that when the bent sections of the two side racks are respectively fit into the fitting lugs of the front frame, with the distance between the connection sections of the two side racks being greater than the distance between the pawls of the rear board, a proper expanding resiliency is demonstrated between the connection sections of the two side racks.

Due to the expanding resiliency between the two side racks, in the assembling process, the pawls on the opposite edges of the rear board can be fit onto the connection sections of the two side racks 12 in a tight engagement manner.

With the present invention, no tool is needed in efficiently assembling the front frame, the two side racks, and the rear board together to provide a stable and firm furniture frame.

In a practical application, if desired, the furniture frame so assembled can be additionally provided with external components/parts, such as a front panel of various configurations, anti-skidding legs, a glass top, and one or more glass partition plates. As such, a piece of furniture that is made of composite materials is provided to thereby realize the objective of the present invention.

In the following description of various embodiments of the present invention, the front frame, the side racks and the rear board can be of various shapes and configurations, which, after being assembled, form furniture frames of various configurations to provide furniture of various configurations with addition of external components/parts thereto.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
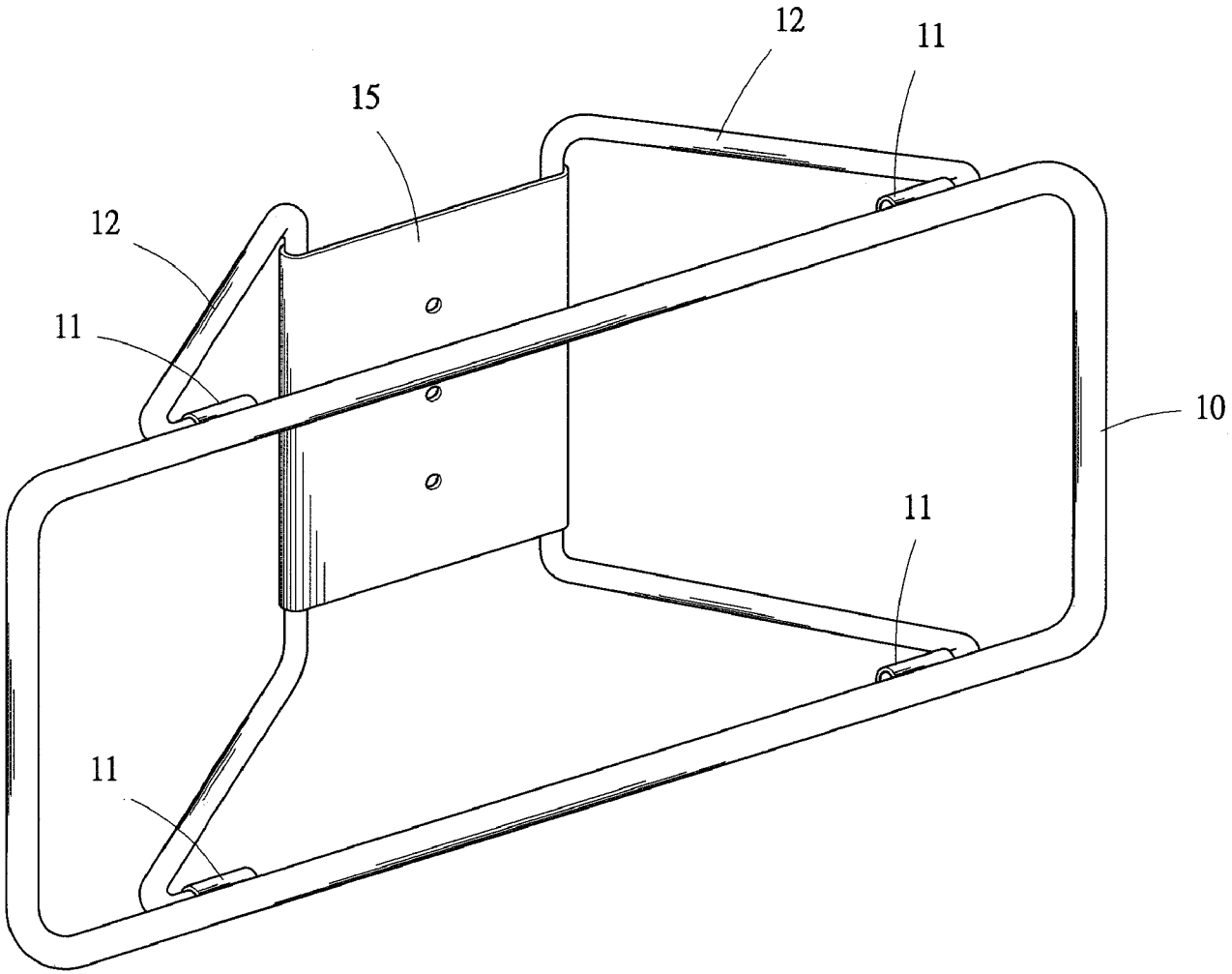
FIG. 1 is a perspective view showing a furniture frame constructed in accordance with a first embodiment of the present invention.
Figure 2:
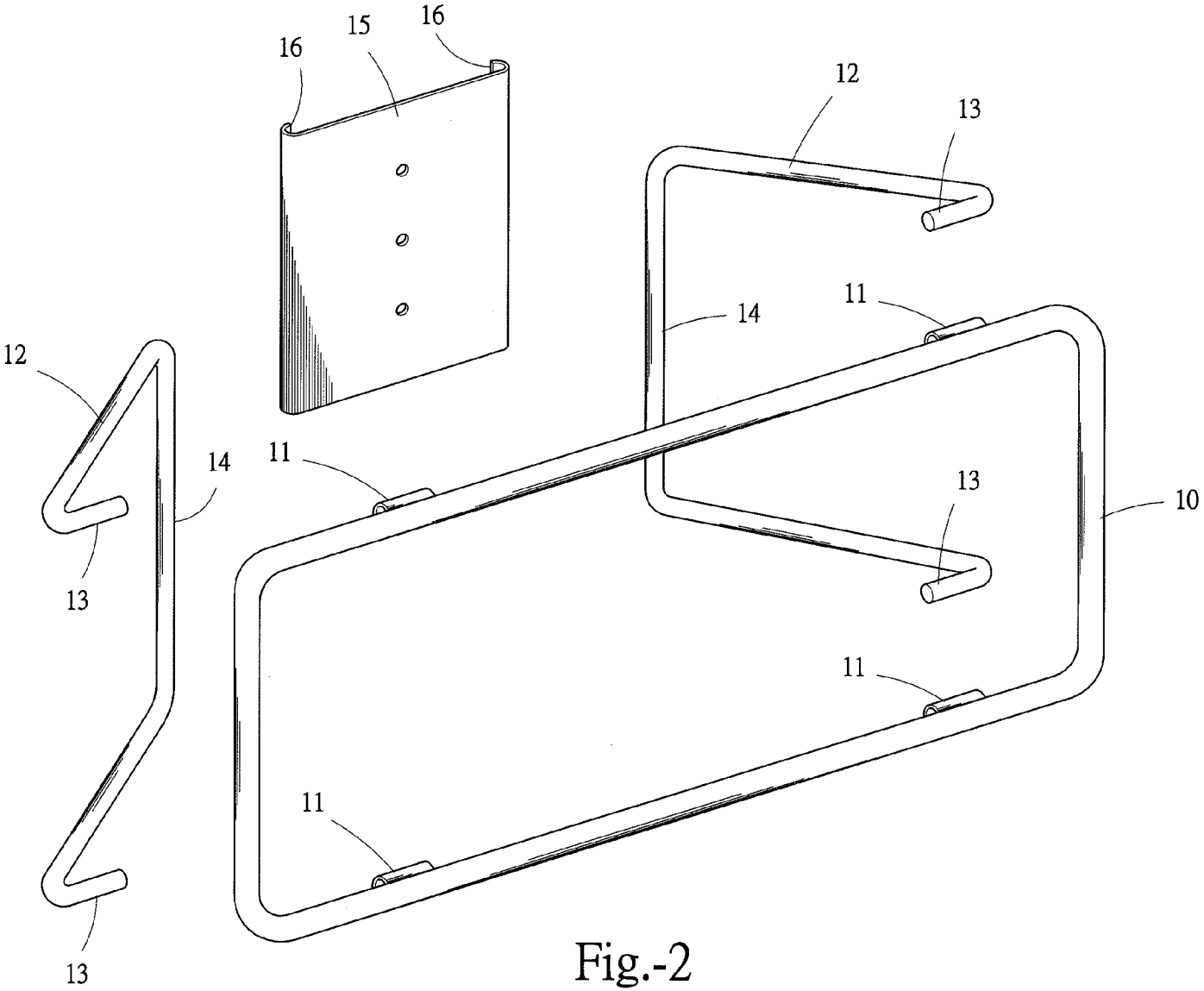
FIG. 2 is an exploded view of the furniture frame of the present invention.

With reference to the drawings and in particular to FIGS. 1 and 2, which respectively show a perspective view and an exploded view of a furniture frame constructed in accordance with the present invention, as shown in FIG. 2, the furniture frame of the present invention generally comprises a front frame 10, a pair of side racks 12, and a rear board 15, which are assembled together to form the furniture frame of the present invention.

The front frame 10 is made of a tubular member and assumes a closed frame like structure. Four fitting lugs 11 are mounted to a rear side portion of the front frame 10 in a substantially symmetric manner.

The two side racks 12 are made of tubular members to each assume a lying U-shaped structure having an open side at which free ends of the limbs of the U-shape each form a bent section 13 that is configured to fit into a corresponding one of the fitting lugs 11, as shown in FIG. 1.

The rear board 15 is in the form of a flat plate having opposite edges that are bent in an arc form to construct pawls 16 on the edges. The pawls 16 on the opposite edges of the rear board 15 are sized and positioned to respectively receive and thus engage connection sections 14 that connect between limbs of the side racks 12, as shown in FIG. 1.

As shown in FIGS. 1 and 2, the side racks 12 are arranged and constructed in a symmetric manner. In assembling, the two bent sections 13 on the open side of the left side rack 12 are respectively fit into the two fitting lugs 11 on the left half of the front frame 10, while the two bent sections 13 on the open side of the right side rack 12 are respectively fit into the two fitting lugs 11 on the right half of the front frame 10.

Each bent section 13 is of a bending angle that is deliberately set so that when the bent sections 13 of the two side racks 12 are respectively fit into the four fitting lugs 11 of the front frame 11, with the distance between the connection sections 14 of the two side racks 12 being greater than the distance between the pawls 16 of the rear board 15, a proper expanding resiliency is demonstrated between the connection sections 14 of the two side racks 12.

Due to the expanding resiliency between the two side racks 12, in the assembling process, the pawls 16 on the opposite edges of the rear board 15 can be fit onto the connection sections 14 of the two side racks 12 in a tight engagement manner.

With the present invention, no tool is needed in efficiently assembling the front frame 10, the two side racks 12, and the rear board 15 together, as shown in FIG. 1, to provide a stable and firm furniture frame.

Figure 3:
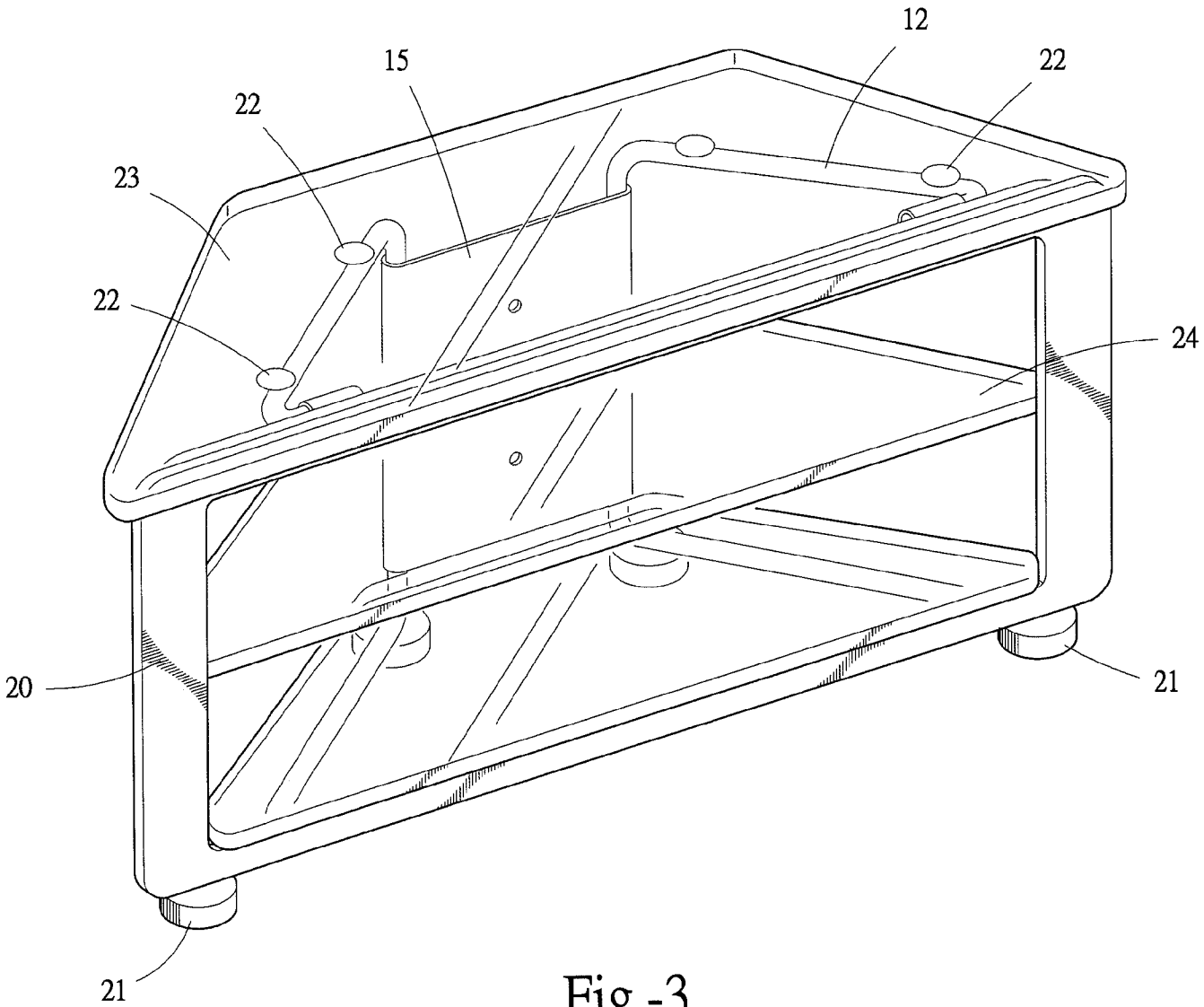
FIG. 3 is a perspective view of the assembled furniture frame in accordance with the present invention.

Also referring to FIG. 3, a perspective view of the assembled furniture frame in accordance with the present invention is illustrated.

As shown in FIG. 3, if desired, the furniture frame so assembled can be additionally provided with external components/parts, such as a front panel 20 of various configurations, anti-skidding legs 21, a glass top 23 that is fixed by suction cups 22, one or more glass partition plates 24. As such, a piece of furniture that is made of composite materials is provided.

Figure 4:
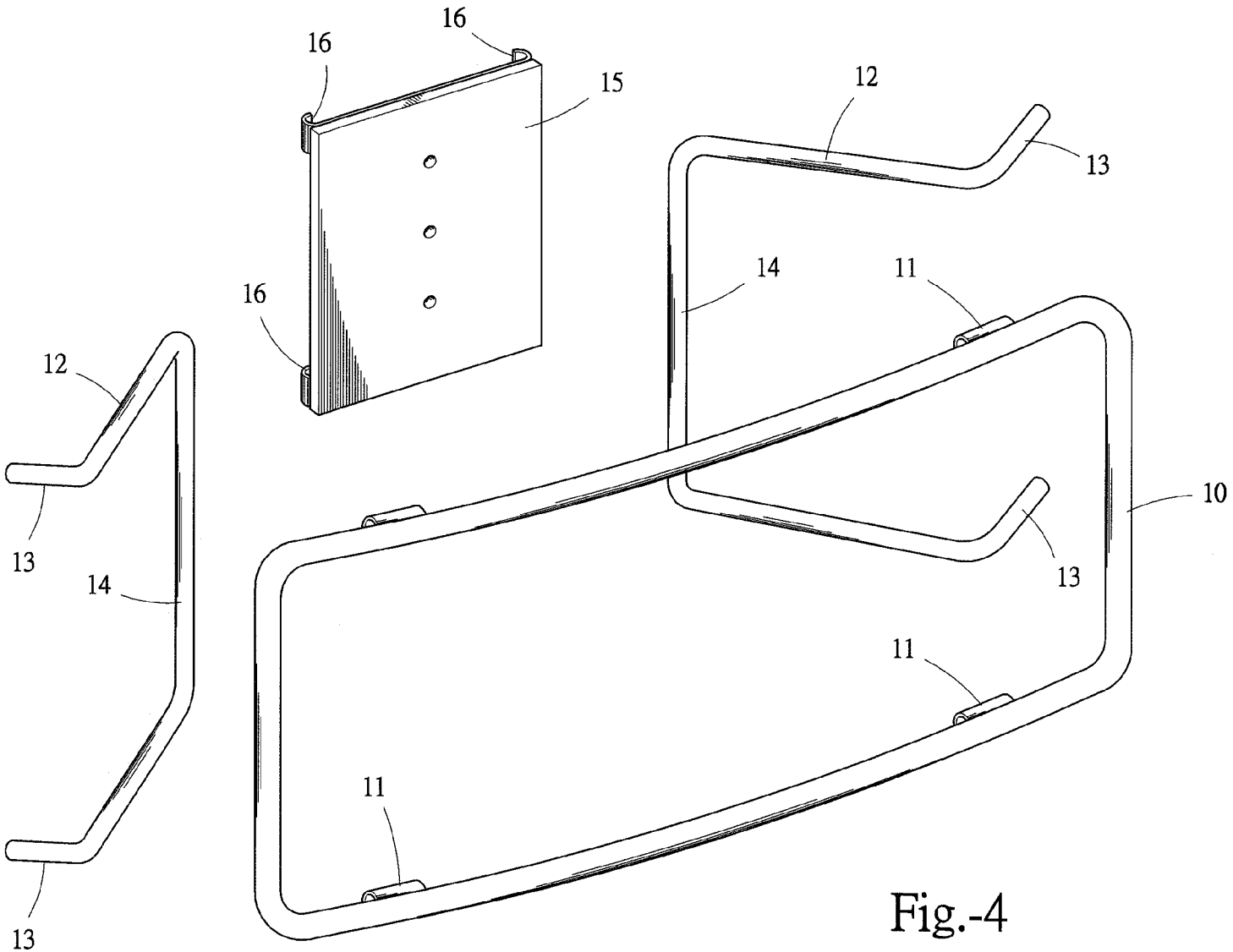
FIG. 4 is an exploded view of a furniture frame constructed in accordance with a second embodiment of the present invention.

FIG. 4 shows an exploded view of a furniture frame constructed in accordance with a second embodiment of the present invention.

In the embodiment illustrated in FIG. 4, a front frame 10 is made in an arc configuration for mating an arc external panel mounted thereto.

Bent sections 13 on an open side of each of two lying-U-shaped side racks 12 are bent outward by a preset angle to allow fitting into fitting lugs 11 mounted at corresponding positions on the front frame 10 along opposite directions.

A rear board 15 is in the form of a flat plate made of a different material and pawls 16 are provided at upper and lower sides of opposite edges thereof.

The second embodiment of the present invention is similar to the first embodiment that has been described previously in that no tool is needed in efficiently assembling the front frame 10, the two side racks 12, and the rear board 15 together to provide a furniture frame that is of a different configuration.

Figure 5:
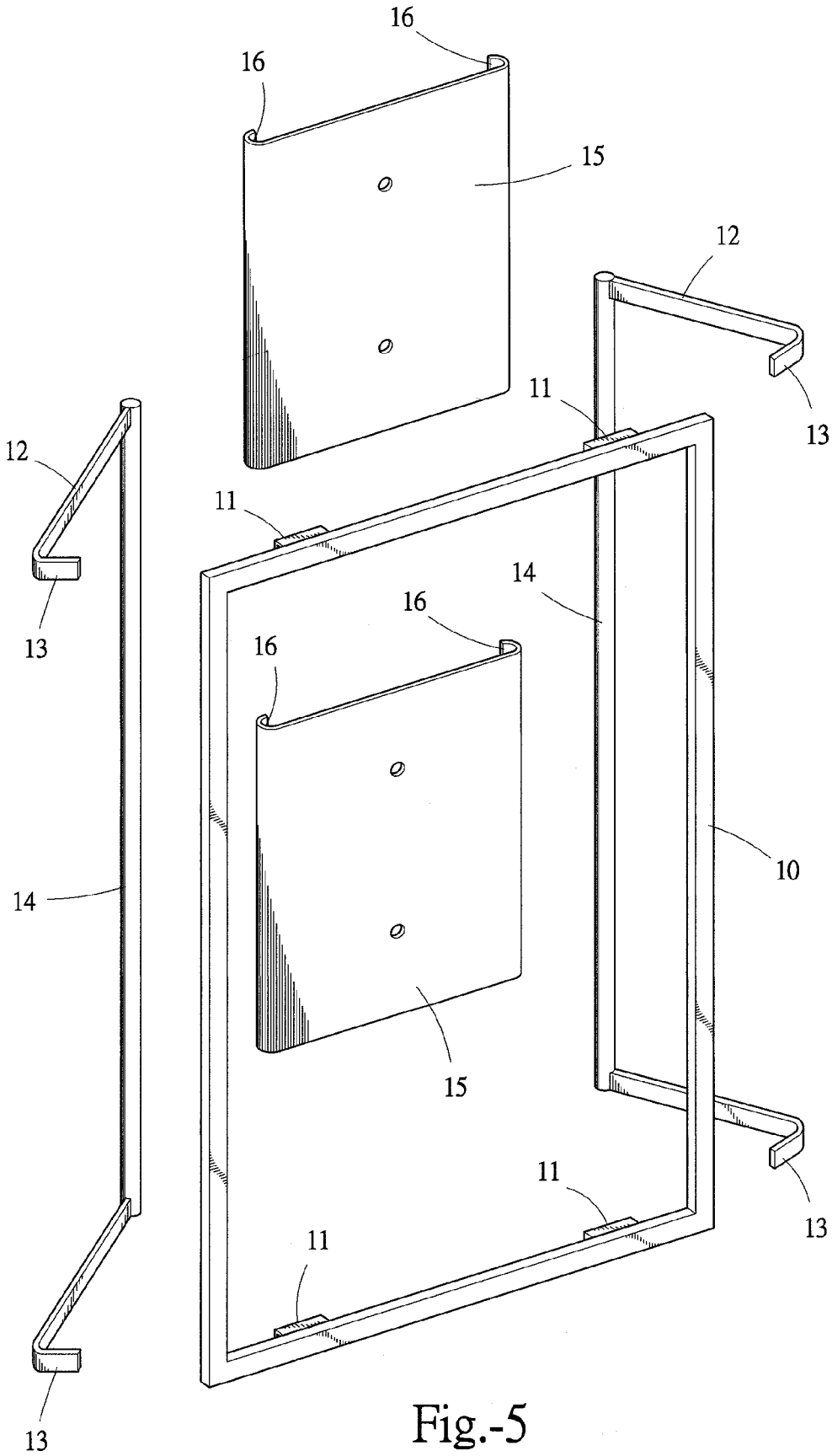
FIG. 5 is an exploded view of a furniture frame constructed in accordance with a third embodiment of the present invention.

FIG. 5 shows an exploded view of a furniture frame constructed in accordance with a third embodiment of the present invention.

In the embodiment illustrated in FIG. 5, a front frame 10 is made of a square or rectangular tube to form a vertically extended rectangular frame for mating a rectangular external panel mounted thereto.

Two side racks 12 are made of round tubes to form connection sections 14 having opposite ends from which square or rectangular tubes extend to thereby construct a lying-U-shaped structure having an open side at which the limbs of U-shape that are connected by the connection section 14 are bent to form bent sections 13 that are fit into fitting lugs 11 mounted at corresponding positions on the front frame 10.

To match the vertically extended front frame 10, a plurality of rear board 15 is provided in this embodiment.

This embodiment of the present invention is similar to the first and second embodiments that have been described previously in that no tool is needed in efficiently assembling the vertically-extended front frame 10, the two side racks 12, and the plurality of rear boards 15 together to provide a furniture frame that is of a different configuration.

The present invention can be of variations in that the front frame, the side racks and the rear board can be of different configurations and shapes and are assembled together to provide furniture frames of different and various shapes and configurations, which together with various front panels, furniture legs, tops, and partition plates, provide furniture of various configuration and shapes.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A furniture frame, comprising:

a front frame, which comprises a closed frame structure made of a tubular member and forms four fitting lugs at a rear side portion thereof in a symmetric manner;

two side racks, which are made of tubular members to each assume a lying U-shaped structure, the two side racks being of a symmetric arrangement and structure, each lying-U-shape having an open side at which free ends of limbs of the U-shape each form a bent section that is configured to fit into a corresponding one of the fitting lugs; and at least one rear board, which has opposite edges that are bent in an arc form to construct pawls thereon, the pawls on the opposite edges of the rear board being sized and positioned to respectively receive and thus engage connection sections that connect between limbs of the side racks;

whereby the front frame, the side racks, and the rear board are efficiently assembleable together without use of tool to provide a stable and firm furniture frame.

2. The furniture frame as claimed in claim 1, wherein when the bent sections of the two side racks are respectively fit into the fitting lugs of the front frame, the connection sections of the two side racks are spaced from each other by a distance that is greater than a distance between the pawls on the opposite edges of the rear board, whereby an expanding resiliency is demonstrated between the connection sections of the two side racks.

3. The furniture frame as claimed in claim 1, wherein the furniture frame that is so assembled is further provided with various external components, including a front panel, anti-skidding legs, a top, and at least one partition plates, which are of various configurations, to form a piece of furniture that is made of composite materials.

4. The furniture frame as claimed in claim 1, wherein the front frame is made in an arc configuration adapted to mate an arc external panel mounted thereto.

5. The furniture frame as claimed in claim 1, wherein the bent sections on the open side of each I side rack are bent outward by a preset angle to allow fitting into the fitting lugs mounted at corresponding positions of the front frame along opposite directions.

6. The furniture frame as claimed in claim 1, wherein the rear board is in the form of a flat plate made of a different material and wherein the pawls are provided at upper and lower sides of the opposite edges thereof.

7. The furniture frame as claimed in claim 1, wherein the front frame is made of a rectangular tube to form a vertically extended rectangular frame adapted to mate a rectangular external panel mounted thereto.

8. The furniture frame as claimed in claim 1, wherein the two side racks each comprises a connection section made of a round tube and having opposite ends from which rectangular tubes extend to thereby construct a lying-U-shaped structure having an open side at which the limbs of U-shape that are connected by the connection section are bent to form the bent sections.

9. The furniture frame as claimed in claim 1, wherein a plurality of rear boards is provided to match the vertically extended front frame.

* * * * *